United States Patent [19]

Rigberg et al.

[11] Patent Number: 4,589,575

[45] Date of Patent: May 20, 1986

[54] HYGIENIC DISPENSER FOR WAFERS

[76] Inventors: Allan Rigberg, 300 E. 75th St. (12B), New York, N.Y. 10021; Jeffrey Lewis, 25 Guyer Rd., Westport, Conn. 06880

[21] Appl. No.: 552,070

[22] Filed: Nov. 15, 1983

[51] Int. Cl.[4] ..... B65H 1/00

[52] U.S. Cl. ..... 221/198; 221/228; 221/232; 221/246; 221/269; 221/289; 206/535

[58] Field of Search ..... 221/25–26, 221/30–31, 197–198, 228–229, 231–232, 246, 268–269, 277, 289, 256; 312/71; 206/536, 535

[56] References Cited

U.S. PATENT DOCUMENTS

| | | | |
|---|---|---|---|
| 2,255,449 | 9/1941 | Mutchler | 221/30 |
| 2,255,450 | 9/1941 | Mutchler | 221/30 |
| 2,274,238 | 2/1942 | Henderson et al. | 312/71 X |
| 2,705,576 | 4/1955 | Amelio et al. | 221/226 X |
| 3,422,991 | 1/1969 | MacDougall et al. | 221/232 |
| 3,515,111 | 6/1970 | Auge | 221/232 X |
| 4,171,753 | 10/1979 | Vreede | 221/197 |

FOREIGN PATENT DOCUMENTS

| | | | |
|---|---|---|---|
| 402367 | 11/1977 | U.S.S.R. | 221/232 |

*Primary Examiner*—Joseph J. Rolla
*Assistant Examiner*—David H. Bollinger
*Attorney, Agent, or Firm*—Michael Ebert

[57] ABSTRACT

A hygienic dispenser for hard candies and medicaments in wafer form, each package of which is constituted by a stack of such wafers protectively sealed in an inner foil wrapper to create a roll that is surrounded by a removable outer sleeve. The dispenser includes a tubular container for receiving the roll through its open end and to seat it on an axially-advanceable platform which urges the roll upwardly. Covering the open end of the container and pivoted thereto is a cap whose thickness corresponds to that of a wafer. The cap is laterally swingable to a cocked position in which the open end is uncovered to release the roll which is then advanced by the platform to engage a visor projecting from the top of the cap, thereby exposing the uppermost wrapped wafer. When the cap is swung back to again cover the open end, it acts to sever the wrapper and discharge the uppermost wafer, the next wafer in the roll then engaging the cap in readiness for the next operation.

5 Claims, 9 Drawing Figures

Fig. 1.
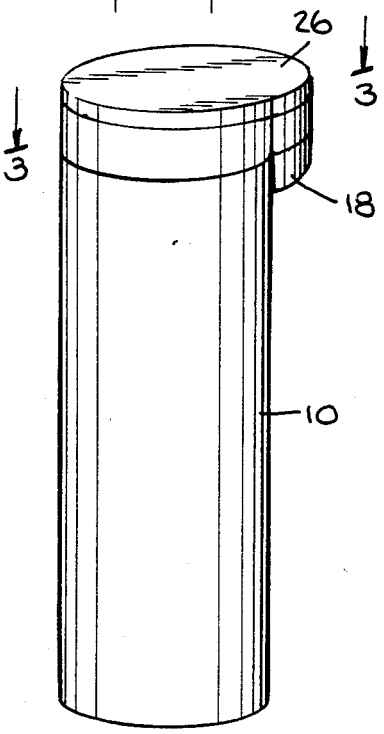
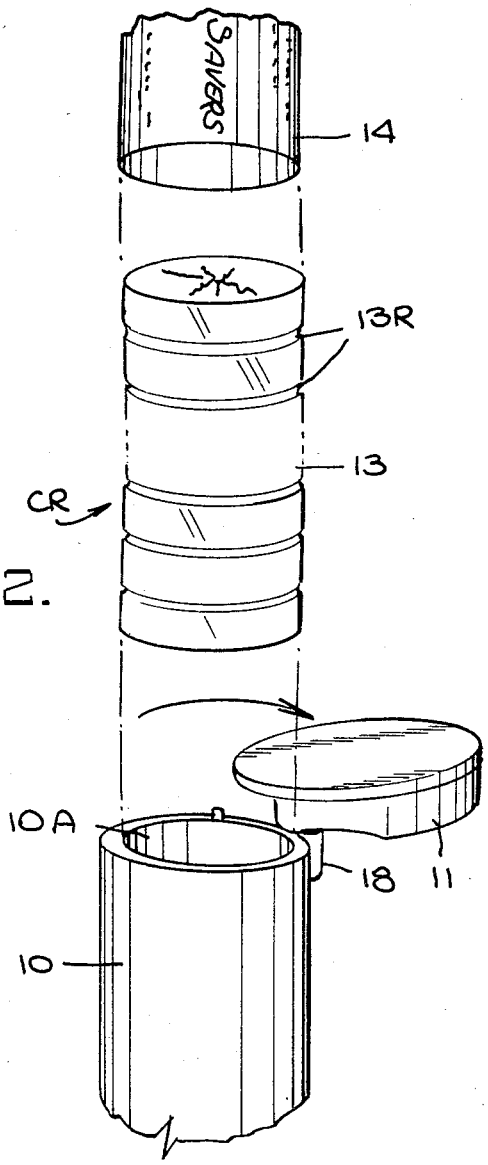
Fig. 2.
Fig. 3.
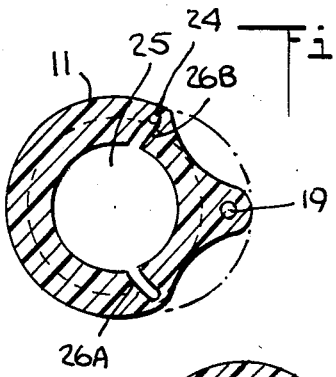
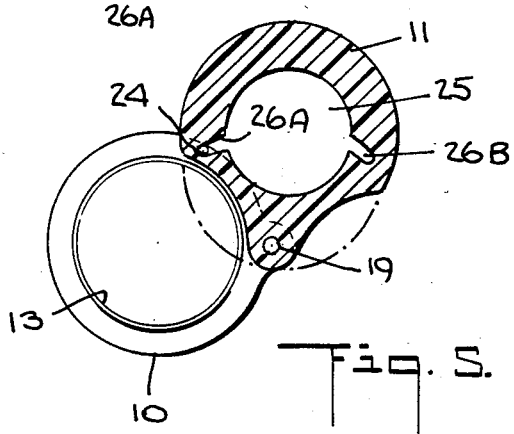
Fig. 5.
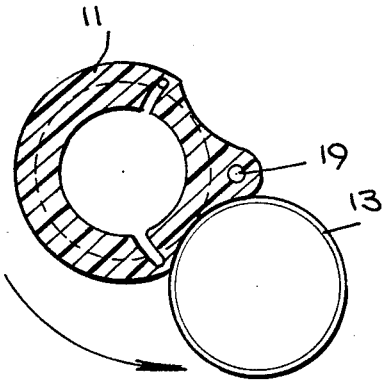
Fig. 6.

HYGIENIC DISPENSER FOR WAFERS

BACKGROUND OF INVENTION

FIELD OF INVENTION

This invention relates generally to a dispenser for hard candies and medicaments in wafer form, each package of which is constituted by a stack of such wafers protectively sealed in an inner foil wrapper surrounded by a removable outer sleeve, and more particularly to a dispenser adapted to receive the roll and to sever and discharge therefrom one foil-wrapped wafer at a time.

Many hard candies and medicaments are fabricated in round wafer form and are packaged in a stack in which the wafers are protectively sealed in an inner foil wrapper to create a roll, the foil wrapper also enclosing the ends of the stack to maintain the contents of the roll in a hygienic condition. Surrounding the roll is a removable sleeve which is printed to identify the product. Candies and medicaments packaged in this fashion are generally referred to roll-type products.

In some instances, instead of disc-shaped wafers, the wafers are in annular form, as in the well-known "Lifesaver" roll candy products. Also commercially available in roll packages are medicaments such as "Rolaids" anti-acid wafers and "Clorets" breath deodorants. The invention is applicable to any roll-type, edible product.

In a typical product in which the wafers are stacked in a wrapped roll, in order for the user to obtain access to the contents, he must first tear off one end of the inner wrapper and the outer sleeve to release one wafer from the roll, being careful to remove no more of the wrapping than is necessary to expose the end wafer. Thereafter, as the user withdraws other wafers from the roll, he continues to peel away the wrapping.

In actual practice, few users exercise sufficient care in unwrapping the roll to prevent the stack from falling apart, as a consequence of which loose wafers are dispersed in the user's pocket or wherever else he stores the roll-type package.

It is known to provide mechanical dispensers for candies and medicaments in wafer form. Thus the Hinterreifer U.S. Pat. No. 3,565,284 shows a dispenser in which loose wafers are stacked within a tube on a spring-biased platform, the wafers being ejected laterally, one at a time, through an opening by means of a pivoted cover.

In the pill dispenser disclosed in the Kovac U.S. Pat. No. 3,471,056, the pills are stacked in a hollow casing on a spring-biased platform and are ejected through a side opening by means of an escapement mechanism. Similar dispensers are shown in the Huck U.S. Pat. No. 3,511,409 and in the MacDougall et al. U.S. Pat. No. 3,422,991.

In all of these prior art dispensers, the wafers or pills must be loaded into the dispenser in a loose, unpackaged condition. Since this involves manual handling of the wafers, they are subject to contamination. Moreover, should the user wish to load a prior art dispenser with wafers taken from a roll-type package, he must first break open this package, and in the process of doing so he may scatter the wafers. Thus, apart from the difficulties involved in unwrapping the package, is the possibility of contamination when carrying out this action.

And while the prior art dispenser may initially be in sterile condition, because its interior wall is in contact with unpackaged wafers, with repeated use and reloading of the dispenser, the interior wall thereof may accumulate candy or medicament particles, as a result of which the dispenser is no longer in hygienic condition.

SUMMARY OF INVENTION

In view of the foregoing, the main object of this invention is to provide a dispenser for wafers contained in a roll-type package in which to load the package into the dispenser, one only removes the outer sleeve. Thus, inserted into the dispenser is an unbroken roll wherein a stack of wafers is protectively sealed by an inner foil wrapper.

A significant advantage of a dispenser of the above type is that the wafers in the stack are isolated from the dispenser and maintained in a hygienic state, no wafer being handled by the user until it is discharged from the dispenser.

More specifically, an object of the invention is to provide a dispenser for a roll-type product in which the dispenser, when operated to discharge a wafer, acts to sever the inner foil wrapper at the junction between the end wafer and the next wafer in the stack, whereby the wafers remaining in the dispenser are protectively wrapped.

Briefly stated, these objects are attained in a hygienic dispenser for hard candies and medicaments in wafer form, each package of which is constituted by a stack of such wafers protectively sealed in an inner foil wrapper to create a roll that is surrounded by a removable outer sleeve. The dispenser includes a tubular container for receiving the roll through its open end and to seat it on an axially-advanceable platform which urges the roll upwardly. Covering the open end of the container and pivoted thereto is a cap whose thickness corresponds to that of a wafer. The cap is laterally swingable to a cocked position in which the open end is uncovered to release the roll which is then advanced by the platform to engage a visor projecting from the top of the cap, thereby exposing the uppermost wrapped wafer. When the cap is swung back to again cover the open end, it acts to sever the wrapper and discharge the uppermost wafer, the next wafer in the roll then engaging the cap in readiness for the next operation.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a dispenser in accordance with the invention shown in the closed state;

FIG. 2 shows the dispenser with its cap swung out to open the container thereof to receive a roll of wafers;

FIG. 3 is a transverse section taken in the plane indicated by lines 3—3 in FIG. 1;

FIG. 5 is a section taken on the plane indicated by lines 5—5 in FIG. 4;

FIG. 6 shows the relationship of the cap to the inner wrapper of the roll as the cap is being swung inwardly to sever this wrapper;

DESCRIPTION OF INVENTION

Referring now to FIGS. 1 and 2, there is shown a dispenser in accordance with the invention for discharging wafers one at a time from a stacked roll thereof, the dispenser including a tubular container 10 and a visored cap 11 pivotally attached thereto. The dispenser container and cap are preferably molded of synthetic plastic material, such as PVC, but other materials such as aluminum may be used.

Figure 7:
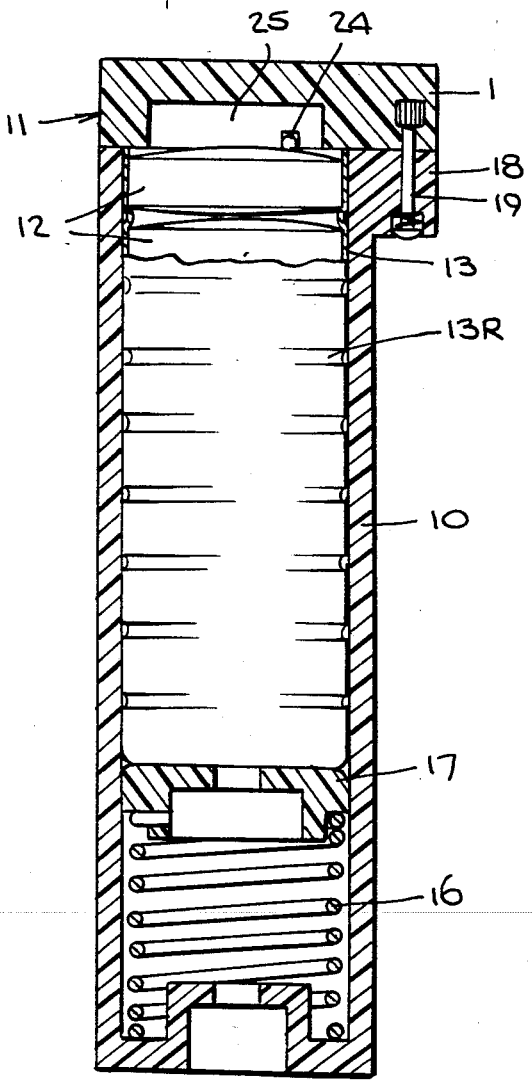
FIG. 7 is a longitudinal section taken through the dispenser when the dispenser cap is closed.

The packaged, roll-type edible product, as best seen in FIGS. 2 and 7, is constituted by a stack of individual hard candies or medicament wafers 12 enveloped within an inner foil wrapper 13 which also covers the ends of the stack to seal the contents and to create a roll CR.

Because, as is shown in the cut-away upper two wafers 12 in FIG. 7, the typical wafer has faces which are slightly convex, this creates a peripheral space between succeeding wafers in the stack. Where the wafers are in toroidal form as in a "Lifesaver" brand roll package, this space between wafers is even more pronounced. Since the inner foil wrapper is tightly wound about the stack, it becomes slightly indented at the junctions between wafers to form annular grooves 13R, each marking the junction point.

In the roll-type package, roll CR is surrounded by a removable sleeve 14 on which is printed identifying indicia, such as "Lifesavers." This sleeve is withdrawn from the roll before it is inserted into the open end 10A of the container, as shown in FIG. 2. This end in the storage mode is closed by cap 11, the cap being swung open fully in the insertion mode to uncover the container to permit the insertion of a fresh roll.

Figure 8:
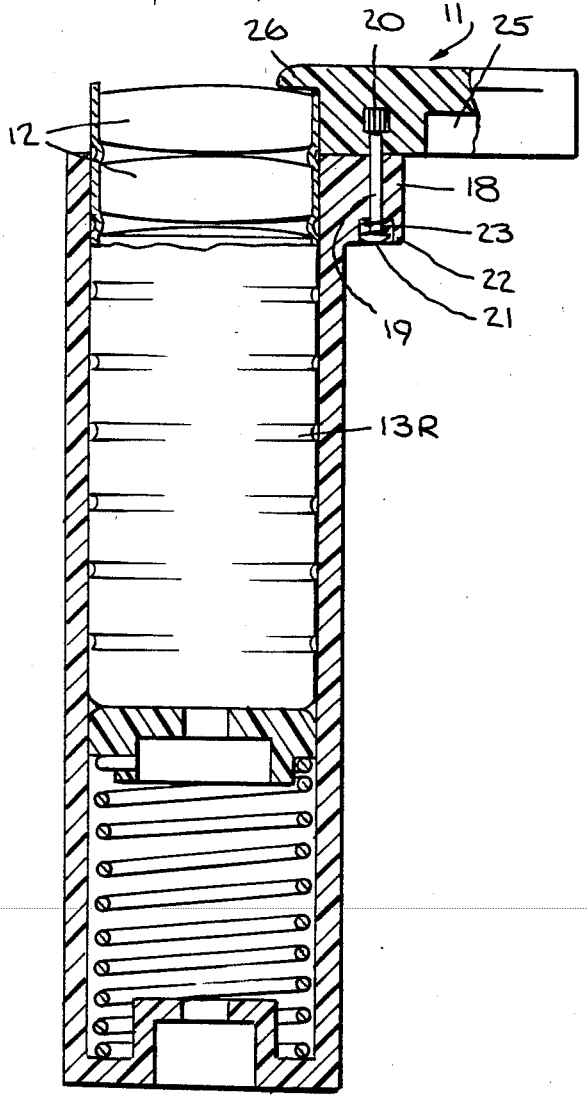
FIG. 8 is a longitudinal section taken through the dispenser when the cap is in its cocked position.
Figure 4:
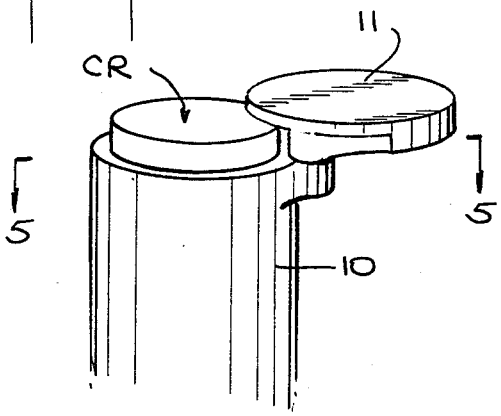
FIG. 4 illustrates the dispenser after the roll of wafers has been loaded into its container, the upper end of the roll engaging a visor on the cap.

The base of container 10, as shown in FIGS. 7 and 8, is provided with a reentrant central pedestal forming a socket for a helical spring 16. The upper end of this spring engages an axially-advanceable platform 17 on which the wafer roll is seated. This spring urges the platform upwardly, causing the upper end of the roll in the storage mode of the dispenser to engage the underface of cap 11. Alternatively, instead of a spring to advance the platform, the arrangement may be of the type found in lipstick dispensers in which the platform on which the lipstick is seated is raised by a helical screw action.

Figure 9:
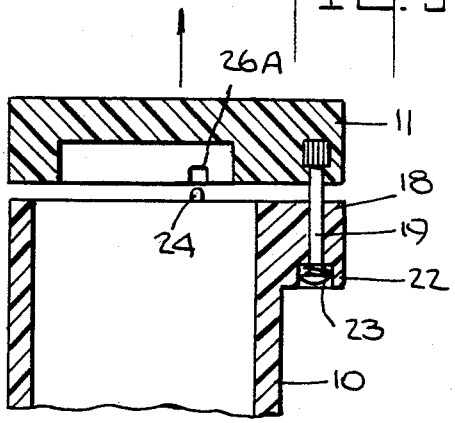
FIG. 9 illustrates the relationship between the cap and the container of the dispenser when the cap is raised to free it from a stop.

The upper end of the container 10 is provided at one side with a ledge 18 which is coupled to the corresponding side of cap 11 by a pivot pin 19 whose upper extremity is provided with an enlarged head 20 embedded in the cap. The lower extremity of pivot pin 19 is provided with a head 21 which is received within a small well 22 housing a helical spring 23. In this way, the cap may be lifted slightly against the action of spring 23 relative to ledge 18, as shown in FIG. 9, to disengage the cap from a stop pin 24 which projects upwardly from the edge of the container.

Cap 11 is provided with a circular depression 25 which, in the storage mode of the dispenser when the cap fully covers the open end of the container, is in axial alignment with the open end. The underside of cap 11, as shown in FIGS. 3 and 5, is provided on opposite sides thereof with a pair of arcuate notches 26A and 26B which cooperate with stop pin 24 so that when the pivoted cap 11 is swung to close the open end in the storage mode, pin 24 is then received in slot 26A to limit further movement thereof. When the cap is swung in the opposite direction so that it assumes its cocked mode shown in FIG. 8 in which the cap is then in readiness for discharging a wafer, pin 24 then lies within slot 26B which limits further movement in this direction.

Cap 11 is provided at its top with a visor 26 which, in the cocked mode of the cap, projects into the space directly above the open end of the container; hence the roll, which is urged upwardly by the platform, then is intercepted by and engages the underside of the visor. The thickness of the cap (exclusive of the top visor) just about matches that of the wafer as shown in FIG. 8.

In the operating mode of the cap, the cocked cap, as shown in FIG. 6, is swung back into its storage mode position, in the course of which movement the cap acts to sever the outer foil wrapper 13 at the junction 13R and to discharge the uppermost wafer in the roll laterally from the dispenser.

At the completion of the operating mode, the cap is returned to the storage mode in which it again covers the roll. When one wishes to dispense another wafer, the cap is again swung out to assume the cocked mode, and it is then swung back in the operating mode to sever and discharge the next wafer.

When all of the wafers in the roll have been discharged and it is necessary to refill the dispenser with a fresh roll, the cap is put into its insertion mode by lifting it away from the container to an extent sufficient to clear stop 25, as shown in FIG. 9, so that the open end may now be freed to receive the roll.

Thus the wafers in the tubular container are protectively wrapped and make no contact at all with the interior wall thereof. And since the wafers are never taken out of the roll until they are discharged one at a time, there is no prior handling of the wafers as with known dispensers, thereby avoiding contamination.

Thus the pivoted cap in the dispenser in accordance with the invention is capable of assuming the following modes relative to the open end of the container:

A. An insertion mode in which the cap is disengaged from the stop pin on the container and can then be fully swung out to uncover the open end of the container in order to receive a fresh roll of wafers.

B. A storage mode in which the cap covers the roll in the container, further angular movement of the cap in one direction being limited by the stop pin.

C. A cocked mode which is the position assumed by the cap when it is swung out in the opposite direction to release the roll which then projects out of the open end to engage the cap visor in readiness for the next action, the projection exposing only the end wafer in the roll.

D. An operating mode in which the cap is swung back to its storage mode position in the course of which it severs the inner foil wrapper at the junction point and discharges the end wafer in the roll.

While there has been shown and described a preferred embodiment of a hygienic dispenser for wafers in accordance with the invention, it will be appreciated that many changes and modifications may be made therein without, however, departing from the essential spirit thereof.

We claim:

1. A hygienic dispenser for edible wafers having a predetermined thickness, the wafers being stacked and being sealed within a wrapper to create a roll; the dispenser comprising:

A. a tubular container having an open end to receive the roll;

B. a platform disposed in said container and axially advanceable therein, the roll being seated on the platform;

C. means to advance said platform to push said roll toward the open end of the container;

D. a cap provided at its top with a visor and having a thickness substantially matching said predetermined thickness, said cap being pivoted on said container and being laterally swingable relative to the open end thereof so that the cap may selectively assume a storage mode position in which it closes the open end of the container, a cocked mode position in which the open end is uncovered by the cap but the visor thereof overlies the open end to permit said platform to push the roll upwardly, thereby projecting the uppermost wrapped wafer above the open end of the container to engage the overlying visor, and an operating mode in which the cocked cap is swung back from its cocked mode position to its storage mode position, in the course of which movement the wrapper is severed by the cap and the uppermost wrapped wafer is discharged laterally from the dispenser; and E. stop means cooperating with said cap to limit movement thereof to said mode positions.

2. A dispenser as set forth in claim 1, wherein said wrapper is a foil inner wrapper surrounded by a removable sleeve which is withdrawn before the roll is inserted.

3. A dispenser as set forth in claim 1, wherein said means to advance said platform is constituted by a spiral spring interposed between the bottom of the container and the platform, said spring urging said platform upwardly.

4. A dispenser as set forth in claim 1, wherein said cap and container are formed of synthetic plastic material.

5. A dispenser as set forth in claim 3, wherein said container is provided with a reentrant bottom defining a socket to accommodate said spring.

* * * * *